US005388838A

United States Patent [19]

Bohrer

[11] Patent Number: 5,388,838

[45] Date of Patent: Feb. 14, 1995

[54] COLLAPSIBLE STIFF GAME BOARD

[76] Inventor: John Bohrer, 515 W. Hutchinson Ave., Apt. #6, Pittsburgh, Pa. 15218

[21] Appl. No.: 247,966

[22] Filed: May 23, 1994

[51] Int. Cl.[6] ..... A63F 3/00
[52] U.S. Cl. ..... 273/285; 273/287
[58] Field of Search ..... 273/285, 286, 287

[56] References Cited

FOREIGN PATENT DOCUMENTS 465570 9/1951 Italy ..... 273/286

*Primary Examiner*—Benjamin H. Layno

[57] ABSTRACT

This invention provides an inexpensive, easy to manufacture, stiff, two-axis collapsible, repeatably markable/erasable, lightweight game board. The game board is comprised of segments loosely attached to one or more fasteners. Upon expansion said segments interlock and maintain the game board shape.

1 Claim, 9 Drawing Sheets

COLLAPSIBLE STIFF GAME BOARD

BACKGROUND

1. Field of Invention

This invention relates to game boards, specifically collapsible, stiff game boards.

2. Description of Prior Art

People whose hobby is playing simulations or games are commonly referred to as gamers. Gamers have a huge variety of serious adult games to choose from, and a large number seem to devote themselves to train games where the common object is the construction of railroads. The gamers are supplied with a large map of a geographic area, used as the game board, within which they will build their railroads. As the gamers build their railroads, they must be able to conveniently mark their trackage on this game board. The game board should easily accept marking with an inexpensive crayon without bunching up, so the game board should be stiff or rigid. They must also be able to easily erase their markings at the end of the game. A game board comprising a map printed on paper and laminated in 1.2 mm (0.05") clear plastic is ideal.

When gamers congregate they want to, and usually do, bring their games with them. The vast majority of these games have the same form, approximately the size of a large book, 22.9 cm×30.5cm×5 cm (9"×12"×2"). This standardized shape offers the gamers the ease of portability they desire. The game board map is invariably larger than 22.9 cm×30.5 cm (9"×12"), so the map should fold or collapse in both axes. Stiff plastic lamination will eventually crack if subjected to repeated fold/unfold operations, ruining the utility of a stiff plastic laminated paper game board.

As consumers, gamers are cost-conscious and prefer inexpensive games. Besides the cost to manufacture, shipping costs impact the gamer's cost of the game, so games of light weight are very beneficial. Among the avid railroad construction gamers, the apparent inability to create an inexpensive, repeatably markable/erasable, stiff, lightweight, two-axis collapsible plastic or plastic-laminated paper game board is known as "the game board problem".

To the best of my knowledge, the first of this type of railroad construction game to be manufactured in any quantity was "Rails through the Rockies" by Adventure Games in 1981. The game board was a very thin printed plastic the thickness of paper, which could be folded up to fit in the game's standard size box. While this met some of the criteria for a useful game board, its lack of rigidity made marking and erasing track difficult. This game board had the additional problem of being expensive to manufacture.

The next railroad construction game, introduced in 1984 by Mayfair Games, was "Empire Builder". This game tried another approach to the game board problem. The map was printed on paper, laminated in plastic, glued to a conventional cardboard game board, and then the conventional gameboard was cut up into an interlocking jigsaw pattern in order to fit in the standard size box. While this solved the aforementioned rigidity problem, this game board was both heavy and expensive to produce.

In 1985, Games Workshop attempted yet another approach to the game board problem when they manufactured "Railway Rivais". The map was printed on paper, glued to a conventional multi-axis multi-fold cardboard game board, and then laminated with a super thin plastic. While this game board solved most of the problems, it was too heavy, too expensive, and after repeated fold/unfold operations the super thin plastic would crack and peel away from the map, especially at the intersections of the folds. This made the game board unerasable and therefore useless.

Mayfair Games tried yet another approach to the game board problem in 1990 with the production of "Eurorails". The map was printed on paper, laminated in plastic, and cut up into thirds with two parallel cuts. These three pieces were then mounted to a conventional two parallel axis folding game board, with the folds located at the cuts such that the game board folded away from the plastic laminate. This method solved some of the game board problem, specifically rigidity and prolonged markability/erasability, but sacrificed other important elements. The game board is heavy and expensive. Worst of all, it can not fit into a standard sized box. The gamers strenuously object to the 25.4 cm×48.3 cm×6.4 cm (10"×19"×2.5") box in which the game is packaged.

In 1992, Mayfair Games made their third attempt to address the game board problem with the simultaneous introduction of their two most recent games, "North American Rails" and "Nippon Rails". The map is printed on paper laminated in plastic. Acknowledging an inability to collapse the plastic laminate in two axes, the game board is rolled up and the game packaged and sold in a 7.6 cm diameter×45.7 cm long (3" diameter×18" long) tube. The tremendous dislike the gamers have for this tube packaging is small compared to the ire it has also now evoked in the distributors and retailers who have to stock and ship this awkward shape.

None of the aforementioned five different attempts, three of them by a single manufacturer, has resulted in a complete, satisfactory solution to the game board problem. My invention solves the game board problem by providing an inexpensive, easy to manufacture, stiff, two-axis collapsible, repeatably markable/erasable, lightweight game board.

OBJECTS AND ADVANTAGES

Accordingly, my invention provides a number of objects and advantages:

(a) to provide a game board that is collapsible in two axes;

(b) to provide a game board that is inexpensive and simple to manufacture;

(c) to provide a game board that is repeatedly markable and erasable;

(d) to provide a game board that is stiff enough to facilitate marking and erasing without bunching up or wrinkling; and (e) to provide a game board that is light in weight.

Further objects and advantages will become apparent from a consideration of the following description and drawings.

DRAWING FIGURES

Reference Numerals List

1=paper map segment
2=map segment laminated in clear plastic sheet
3=clear plastic border
4=hole
5=slit
6=fastener

DESCRIPTION—FIGS. 1 TO 4

Figure 1:
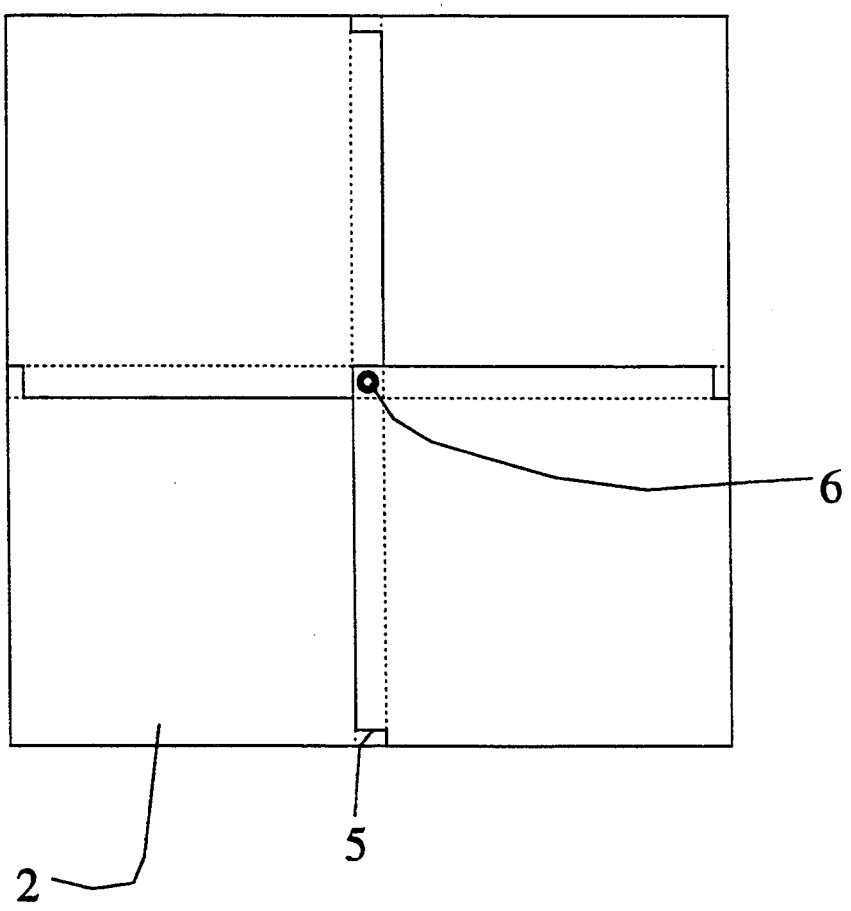
FIG. 1 shows a top view of the fully expanded game board set up for play.
Figure 2:
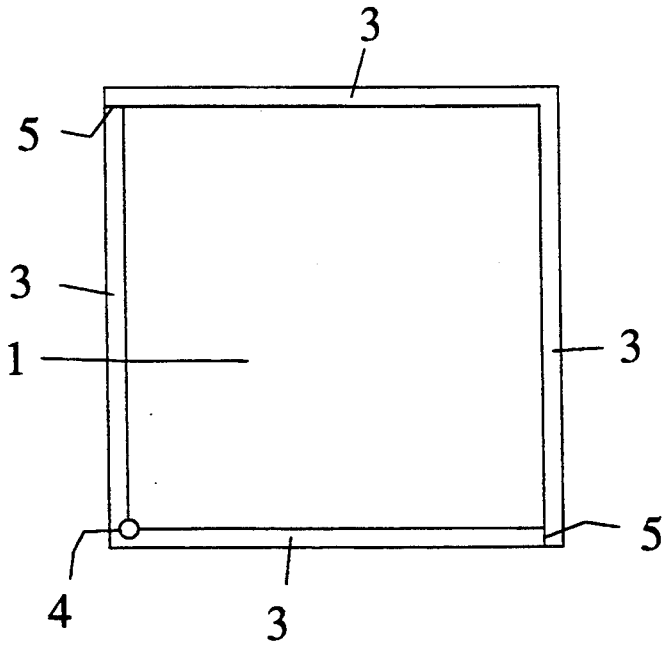
FIG. 2 shows a top view of one of the squares or segments of the game board.
Figure 3:
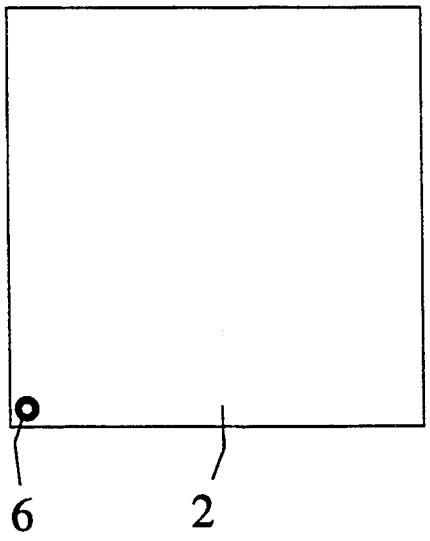
FIG. 3 shows a top view of the fully collapsed game board.
Figure 4:
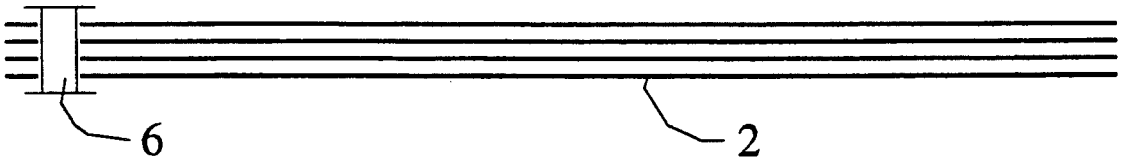
FIG. 4 shows a side view of the fully collapsed game board.

The preferred embodiment of the present invention is shown in FIG. 1. The map is printed on a square piece of paper and then cut into four smaller squares or segments. Each of these paper segments 1 is laminated in clear plastic 2 as shown in FIG. 2, preferably between two 1.2 mm (0.05") sheets. These plastic laminated sheets 2 are trimmed with a 6.4 mm (¼") plastic border 3 around the paper. A 6.4 mm (¼") hole 4 is punched in each of these segments, centered at the comer of the paper that corresponded to the center of the map before it was originally cut into segments. Two slits 5 are cut into the 6.4 mm (¼") plastic border of each of these segments. The four segments are lined up one on top of the other as shown in FIG. 3 with the map side of each facing the same direction such that the hole 4 is visible through all four segments. As shown in FIG. 4, an eyelet or fastener 6 is inserted into the hole 4 and the segments are fastened together loosely enough to allow individual segments to rotate freely around the fastener 6.

OPERATION—FIGS. 1 AND 3

FIG. 3 shows the collapsed game board at the end of manufacture. To fully expand the game board the individual segments are rotated around the fastener until each printed map segment is in the same quadrant it was in when the map was printed. The slits of each segment provide an interlock at the sides of each segment. Engage three pairs of corresponding slits. To engage the fourth pair of slits, gently warp the corresponding stiff plastic laminated segments enough to allow the slits to engage. When all four pairs of slits have been engaged, the game board is fully expanded and each segment is rigidly locked into its position relative to the other segments.

SUMMARY, RAMIFICATIONS AND SCOPE—FIGS. 5 TO 9

Figure 5:
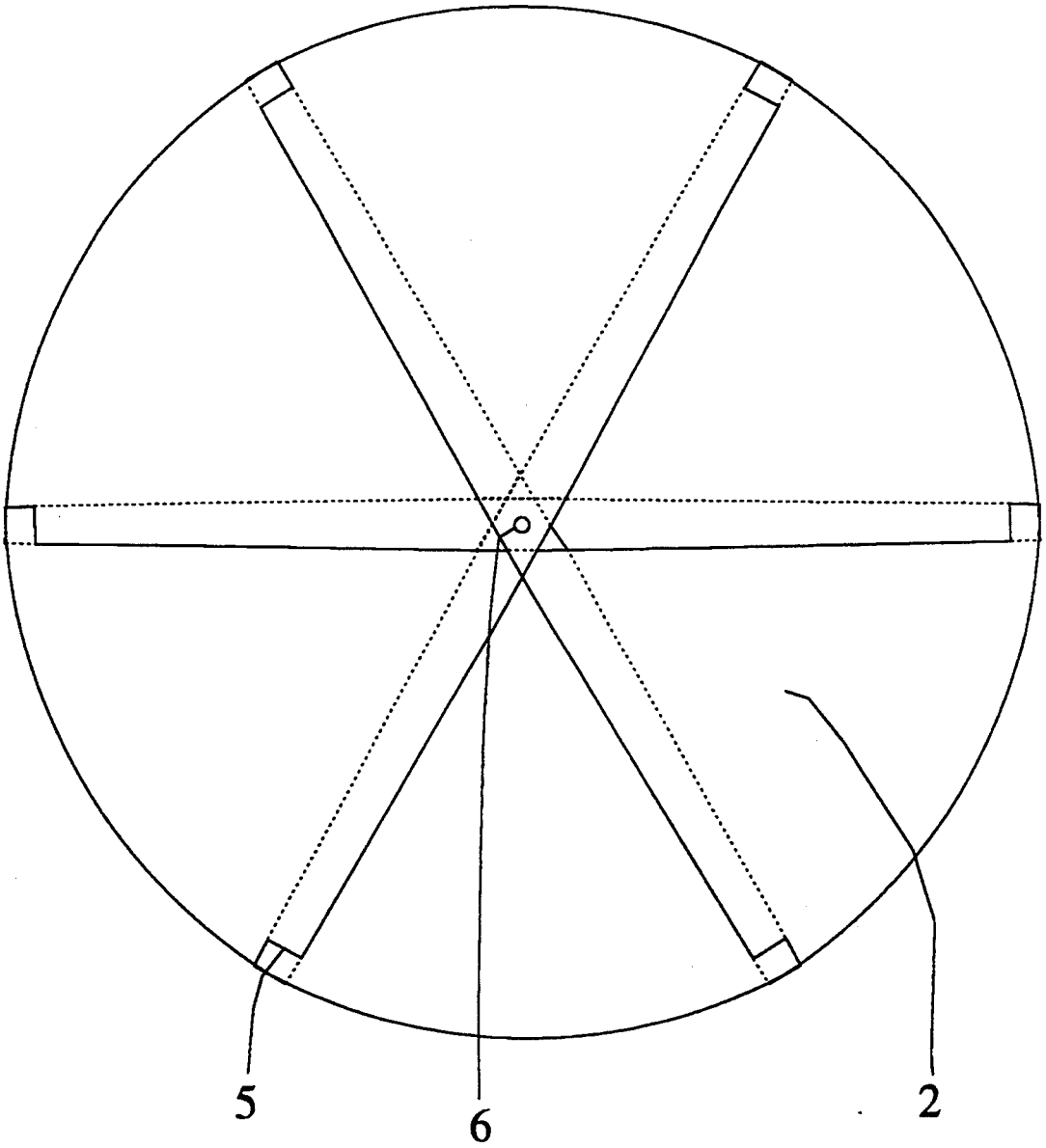
FIG. 5 shows a top view of a fully expanded circular game board.
Figure 6:
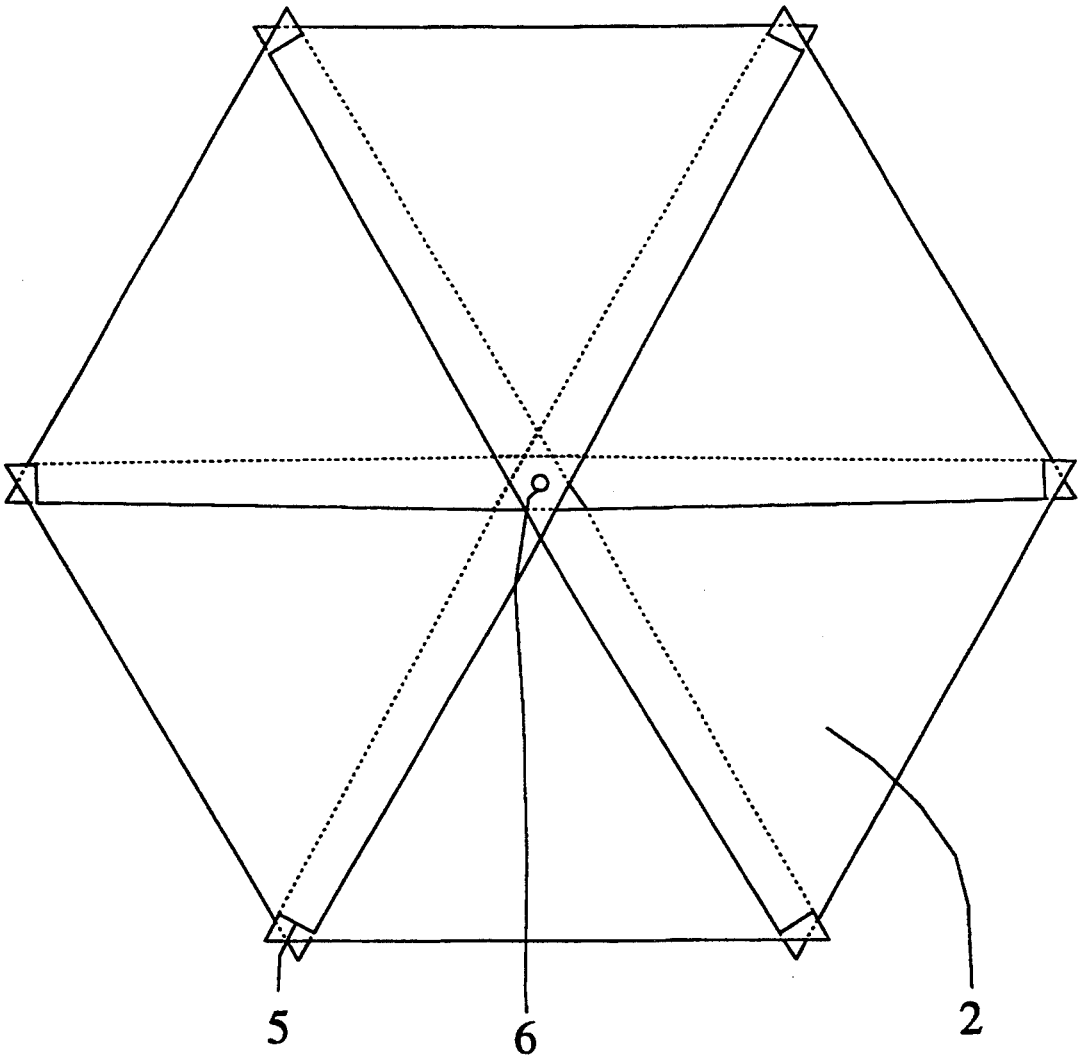
FIG. 6 shows a top view of a fully expanded hexagonal game board.
Figure 7:
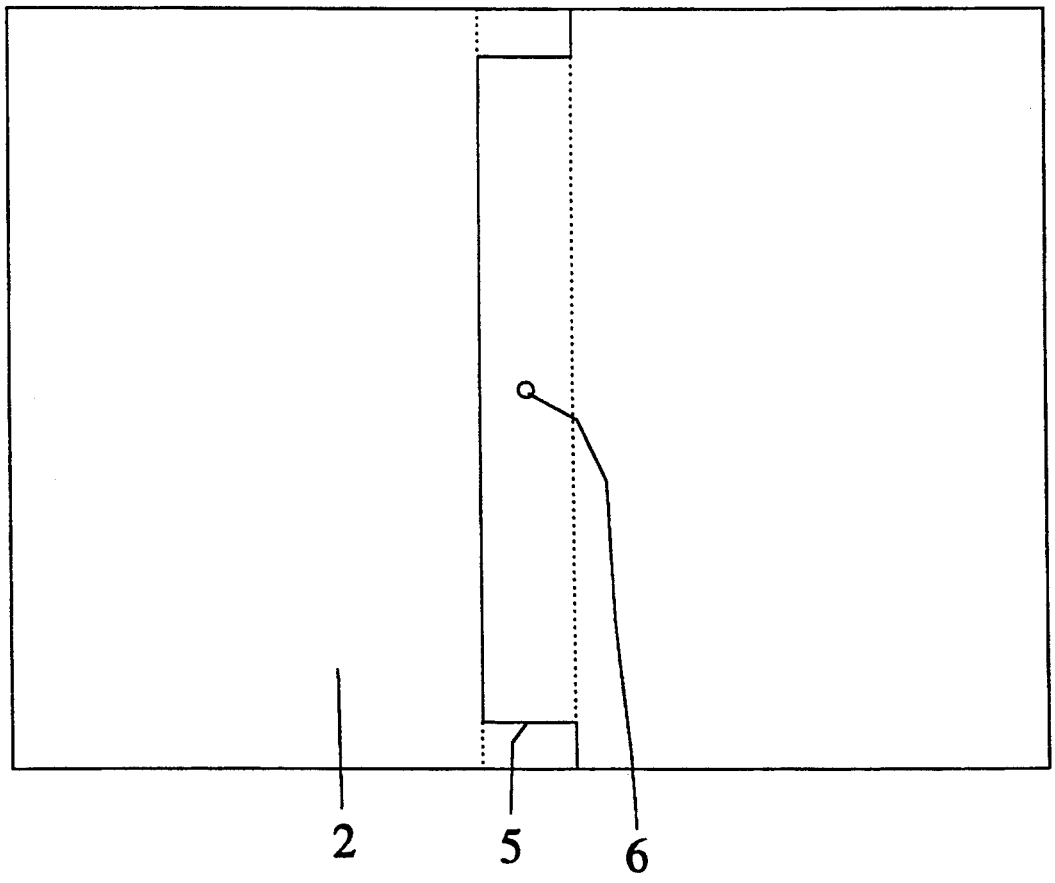
FIG. 7 shows a top view of a fully expanded 2 segment game board.
Figure 8:
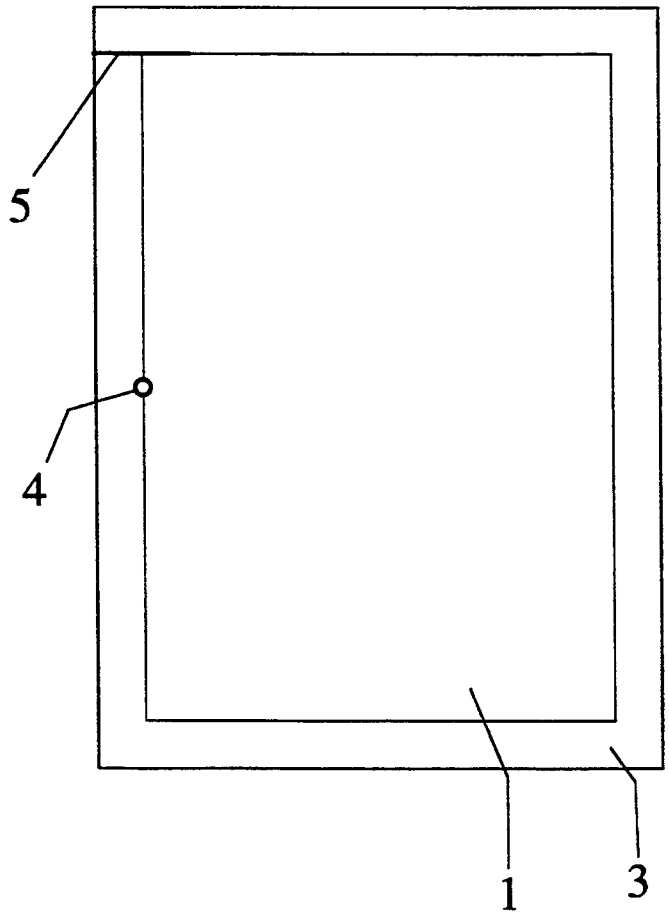
FIG. 8 shows a top view of a single segment of the game board shown in FIG. 7.
Figure 9:
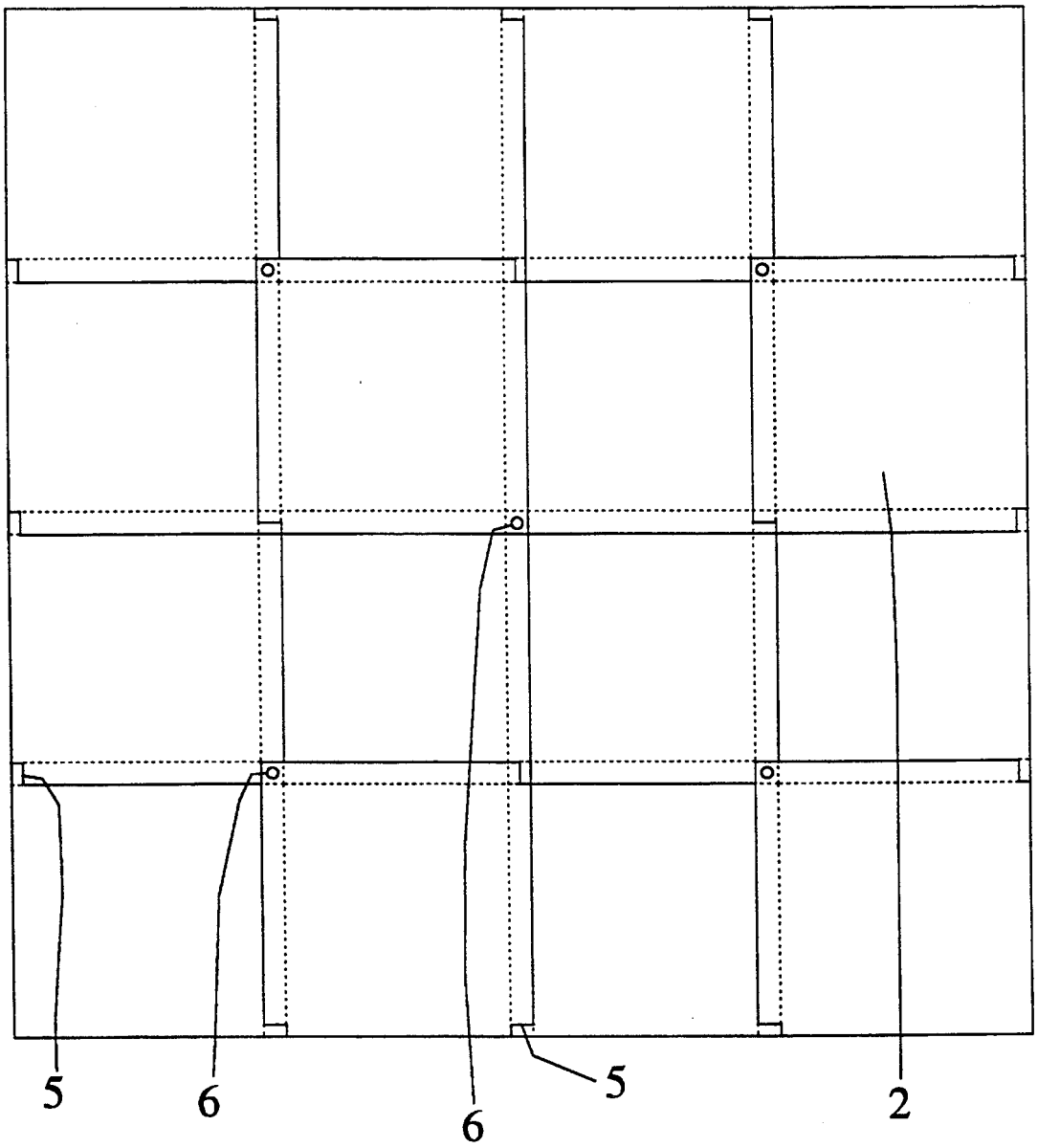
FIG. 9 shows a top view of a fully expanded 16 segment game board.

My invention provides an inexpensive, easy to manufacture, stiff, two-axis collapsible, repeatably markable/erasable, lightweight game board. While the preferred embodiment shows a square, the game board may be produced as a circle, as shown in FIG. 5, by cutting the map segment into arcs. Any regular polygon may be fashioned by cutting the map segments into triangles. As an example, a hexagon is shown in FIG. 6. The simplest shape is a two segment, with only one slit per segment, collapsible rectangle as shown in FIG. 7. A single segment is shown in FIG. 8 A more complex version is a square map cut into 16 smaller squares as shown in FIG. 9.

The game board has numerous set-up patterns. The four segment preferred embodiment may be set-up in any of six distinct patterns. A fifth square could be added so that when the map was interlocked any of the segments, save the top one, could be hidden under another, visible segment. This increases the pattern variability to 12 variations.

The game board may be made from several different stiff (but not inflexible) materials, including plastic-laminated paper, metal, and plastic.

The invention is not limited to use solely as a game board. The utility extends to collapsible signs, collapsible displays, and collapsible magic slates. Thus, the scope of the invention should be determined by the appended claims and their legal equivalents, rather than by the examples given.

I claim:

1. A collapsible, stiff game board which comprises:

(a) two or more identically shaped game board segments, each having one or more holes at identical locations, and one or more slits at identical locations at one or more borders of each of said game board segments, said game board segments are stacked on top of one another such that said holes vertically align with one another;

(b) a fastener securing said game board segments at said vertically aligned holes, whereby said game board segments pivot about said fastener along a vertical axis from a collapsed position wherein the borders of said game board segments are lined up such that said game board segments are directly stacked one on top of the other and only the playing surface of the top game board segment is exposed, to an expanded position wherein the playing surfaces of all of said segments are exposed; and (c) a means to interlock said game board segments at said slits for rigidly locking said game board segments in said expanded position.

* * * * *